United States Patent [19]

Naslund

[11] Patent Number: 5,038,480

[45] Date of Patent: Aug. 13, 1991

[54] VIBRATION DAMPING DEVICE

[75] Inventor: Ulf W. Naslund, Huskvarna, Sweden

[73] Assignee: Aktiebolaget Electrolux, Stockholm, Sweden

[21] Appl. No.: 415,047

[22] Filed: Sep. 28, 1989

[30] Foreign Application Priority Data

Sep. 30, 1988 [SE] Sweden ..... 8803489

[51] Int. Cl.[5] ..... B27B 17/02

[52] U.S. Cl. ..... 30/383; 173/162.2

[58] Field of Search ..... 173/162.2; 30/381, 383

[56] References Cited

U.S. PATENT DOCUMENTS

| | | | |
|---|---|---|---|
| 3,813,776 | 6/1974 | Frederickson et al. | 30/381 |
| 3,845,557 | 11/1974 | Bailey | 30/381 |
| 4,324,045 | 4/1982 | Höppner et al. | 30/383 |
| 4,694,578 | 9/1987 | Kemmler | 30/383 |
| 4,896,426 | 1/1990 | Nagashima | 30/383 |

*Primary Examiner*—Frank T. Yost
*Assistant Examiner*—Scott A. Smith
*Attorney, Agent, or Firm*—Pearne, Gordon, McCoy & Granger

[57] ABSTRACT

Damping device for a vibration damping system in chain saws having an adjustment spring characteristic for various applications. The element (10) according to the invention is an elongated elastomer element attached in the middle of a handle part and fastened at one end to the driving side of the crankcase. The second end enters into a cylindrical cavity (20) formed in the crankcase wall supporting the start apparatus, said cavity having a larger diameter than the element. In that way the characteristic of the element is primarily determined by the end fastened to the driving side but gradually, when the load on the element increases, also by the end entered into the cavity.

5 Claims, 2 Drawing Sheets

VIBRATION DAMPING DEVICE

BACKGROUND OF THE INVENTION

The present invention relates to vibration damping devices of elastic material, and more particularly to the use of such devices in chain saws thereby reducing the vibrations from the engine and the guide bar during operation.

In general, a chain saw comprises two primary components; a body and a handle. The body includes a motor having a crankcase, a guide bar attachment, an endless cutter chain, and means for rotating the endless cutter chain about the guide bar attachment. The handle includes a manual gripping portion, a frame portion, and often times a fuel tank and an oil tank. The body and the handle are interconnected so they can move independent from one another.

It is know in the art to arrange vibration dampers of rubber or steel springs in the body or the handle of the chain saw by either fastening them with screws of pressing them into seats formed in the saw. When designing such damping devices there is a problem with balancing between stiff and soft elements so that the damping of the vibrations becomes efficient while at the same time obtaining sufficient stiffness between the handle and the body for guiding the saw during operation. Under extreme conditions, such as sawing very dense wood or using an abnormally long guide bar, it is desired to otain a very progressive spring characteristic when large deflections occur in the damping arrangement. In order to obtain such a progressive characteristic special fastening arrangements and a reinforcement of the element with a stiffening means are required whose influence on the elasticity of the element does not take place until a certain deflection has occurred.

SUMMARY OF THE INVENTION

The main feature of the preferred embodiment of the present invention is to provide a damping element with fastening and stiffening means thereby achieving a progressive spring characteristic in the element. This is accomplished by an elastic or elastomer body, having a proximal and distal end, fastened at its center to the handle of the chain saw. The element is attached by a screw joint at its proximal end to an outer portion of the driving side of the crankcase adjacent the guide bar attachment. The distal end of the element extends to the other side of the crankcase where it projects into a cavity formed by the crankcase end wall having a cross section larger than the cross section of the distal end of the element. The damping characteristic of the element during small deflections is defined by the proximal end which is attached to the driving side of the crankcase. Only when the deflection becomes so large that the distal end comes into contact with the interior wall of the cavity does the spring constant of the element increase. Furthermore, is a more progressive spring characteristic is desired (larger final stiffness) a stiffening element can be inserted into a cavity located in the distal end of damping element.

BRIEF DESCRIPTION OF THE DRAWINGS

An embodiment of the vibration damping element according to the preferred embodiment of the invention will be described in the following with reference to the attached drawings in which.

DETAILED DESCRIPTION OF THE PREFERRED EMBODIMENT

Figure 1:
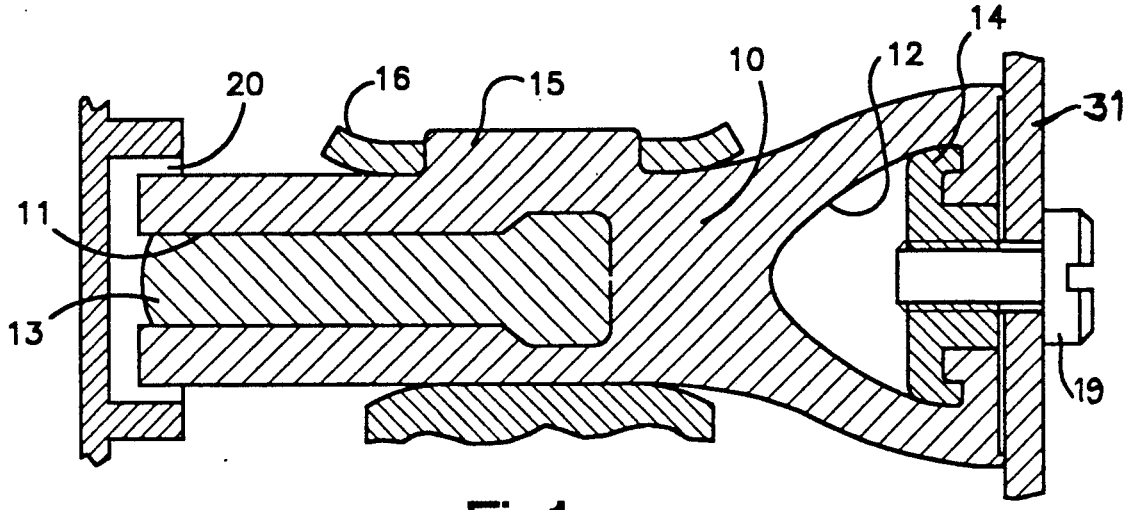
FIG. 1 is a longitudinal cross section through the damping element.

Referring to FIG. 1, there is shown a vibration damping element 10 which is substantially elongated and spans most of the width of the chain saw's body substantially perpendicular to the guide bar attachment 30. At each end of the element 10 there is a cavity 11 and 12, respectively, into which a stiffening element 13 and a fastening element 14, respectively, can be inserted. The center part of the element 10 is held in a seat formed in a supporting surface of a tank 17 connected to the handle of the chain saw. In the center part of the element 10 a shoulder 15 is fitted into a bracket or otherwise connected to the seat.

Figure 2:
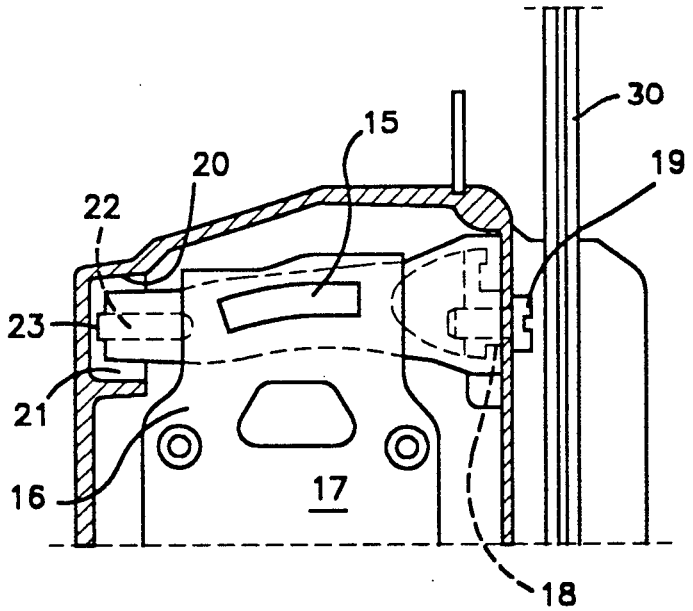
FIG. 2 is a horizontal cross section of the front end of a chain saw with the element attached.
Figure 3:
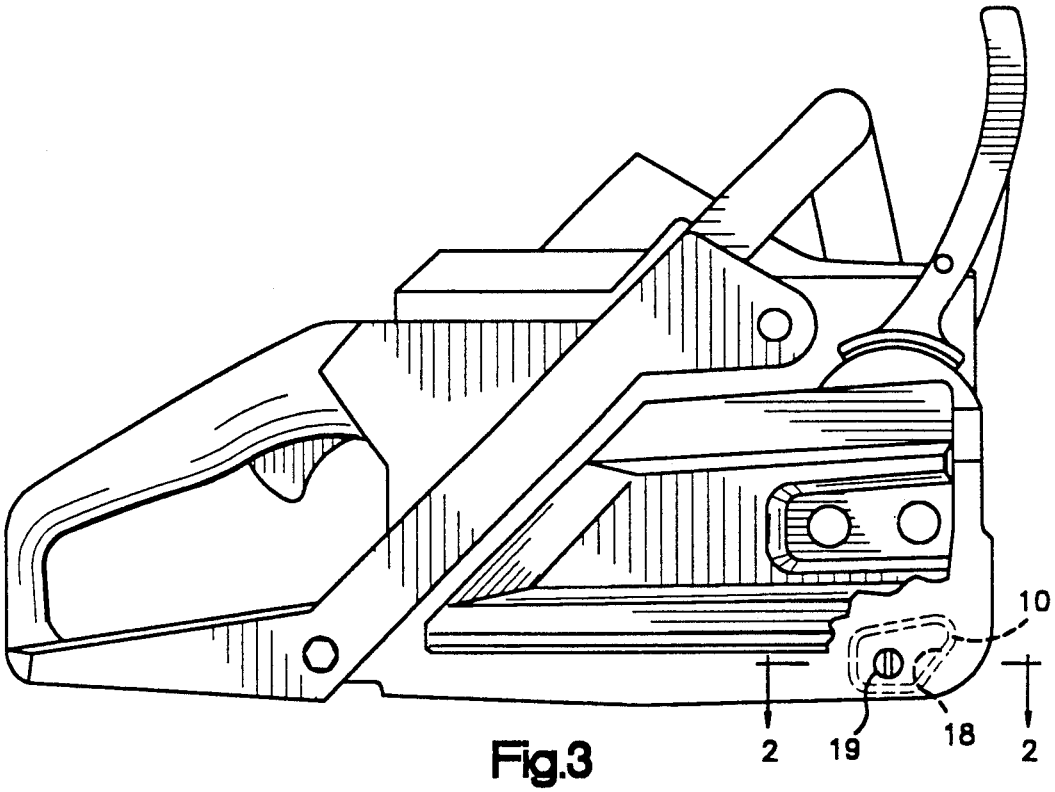
FIG. 3 is a side projection of the driving side of the chain saw.

An example of the use of the element 10 is illustrated in FIGS. 2 and 3. The element 10 is shown attached by means of a bracket 16 to the tank 17 of the chain saw so that the ends of the element 10 project on each side of the tank 17. The proximal end of the element 10 is connected to the inside of a crankcase shield 31 adjacent the guide bar attachment 30. A bushing 14 and a screw 19 are inserted into the cavity 12 to anchor the proximal end to the crankcase shield 31. It is preferred that the proximal end of the element 10 is connected to the crankcase by the screw 19 at a point aside the longitudinal axis of the element 10 (FIG. 3). This is because the proximal end of this location of the attachment achieves the best operating results.

The distal end of the element 10 projects into a cavity 20 formed by the crankcase end wall within the opposite interior side of the body. The cavity 20 has a larger cross section than the distal end of the element 10 so that a space 21 is formed around the circumference of the distal end of the element 10. The distal end contacts the interior wall of the cavity 20 only when the crankcase and, accordingly, the engine are moved relative to the handle through a distance corresponding to space 21. Thus, the spring characteristic of the element 10 is determined in two stages. The first stage characteristic is determined only by the proximal end fixed to the crankcase when vibrations or relatively small deflections occur. The second stage characteristic is determined when the feed pressure on the saw increases thereby causing the distal end of the element 10 to contact the interior wall of the cavity 20 thereby increasing the spring constant of the element 10.

In extreme circumstances, e.g., in case of long guide bars or a blunt chain, a large progressiveness (large final stiffness) is required in the spring characteristic of the element 10. The element 10 has a cylindrical cavity 11 in the distal end into which a stiffening element 13 such as a bar of plastic or metal, or a steel spring is inserted. When the stiffening element 13 is inserted the element 10 has an increased capability to dampen vibrations resulting from large deflections. By choosing a stiffening element 13 made from material with varying qualities the desired final stiffness of the element 10 can be obtained.

Figure 4:
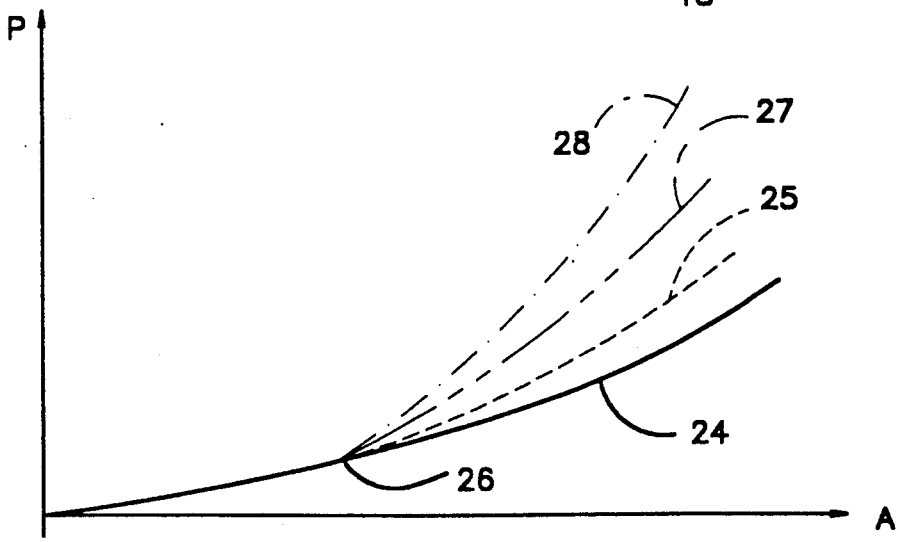
FIG. 4 is a diagram showing the spring power P/amplitude A, when using different stiffening means in the element.

The diagram in FIG. 4 shows characteristics in respect of the element 10 with different stiffening elements introduced into the distal end. The lowest, continuous curve 24 is the spring power arising from the proximal end fixed to the crankcase shield 31 by fastening element 14. A discontinuity occurs in the next curve 25 at the point 26 when the distal end (when the cavity 11 is empty) hits the interior wall of the cavity 20. With different stiffening elements inserted into the cavity 11 such as a screw spring (curve 27) or a plastic rod (curve 28) a larger spring power in the element 10 is obtained after the breaking point 26.

The element 10 is located near the front end of the body. In order to get the element's 10 operating center at both the proximal and distal ends as far forward as possible, it is preferred that its shape be asymmetrical, i.e., the end surface of the proximal end next to the guide bar attachment 30 is formed as the available space in the body will allow (FIG. 3). It is apparent that more damping elements are included in the chain saw than the one shown here, and that all elements can have an asymmetrical shape dictated by the available space in different parts of the saw body.

While the invention has been shown and described in detail, it is recognized that various modifications and rearrangements may be resorted to without departing from the scope of the invention as defined in the claims.

What I claim is:

1. In a chain saw having a handle, and a body including a motor having a crankcase, and a guide bar attachment, a vibration damping device comprising an elongated element (10) of elastic material having a distal end and a proximal end, said distal end having a first cavity formed therein, said proximal end having a second cavity formed therein and provided with a fastening means (14), one of said ends being connected to said body thereby defining a spring constant, said other end extending into a third cavity defined by said body having a cross section larger than said other end such that said other end extends into said third cavity and is spaced from inner surfaces of said third cavity when vibration oscillations of said body are less than a predetermined amount, said elongated element also being connected to said handle whereby said other end contacts said inner surfaces of said third cavity when vibration oscillations of said body exceed said predetermined amount, thus reducing vibrations in said handle.

2. In a chain saw as recited in claim 1, said vibration damping device further comprising a shoulder (15) forming a part of said element (10) near its center, said shoulder (15) connected to a bracket projecting from said handle.

3. In a chain saw as recited in claim 2, said vibration damping device further comprising a stiffening element having a higher spring constant than that of said proximal end provided with said fastening means, said stiffening element inserted into said first cavity of said distal end.

4. In a chain saw as recited in claim 3, said vibration damping device wherein said proximal end provided with said fastening means is connected to said body thereby producing the characteristic of said vibration damping device at small vibration oscillations of said body.

5. In a chain saw as recited in claim 4, said vibration damping device wherein said proximal end provided with said fastening means is connected to said body at a point (19) located aside the longitudinal axis of said element.

* * * * *